US007422493B2

(12) United States Patent
Wang et al.

(10) Patent No.: US 7,422,493 B2
(45) Date of Patent: Sep. 9, 2008

(54) TERMINAL AND ELECTRICAL CONNECTOR

(75) Inventors: Hsu-Fen Wang, Hsin-Tien (TW); Kuei-Chung Tsai, Hsin-Tien (TW)

(73) Assignee: Advanced Connectek Inc. (TW)

( * ) Notice: Subject to any disclaimer, the term of this patent is extended or adjusted under 35 U.S.C. 154(b) by 0 days.

(21) Appl. No.: 11/891,814

(22) Filed: Aug. 13, 2007

(65) Prior Publication Data

US 2008/0045088 A1 Feb. 21, 2008

(30) Foreign Application Priority Data

Aug. 16, 2006 (TW) ..... 95214457 U

(51) Int. Cl.
*H01R 4/68* (2006.01)

(52) U.S. Cl. ..... 439/862

(58) Field of Classification Search ..... 439/862, 439/816, 83, 159, 66, 326, 495, 67, 77, 843; 324/754

See application file for complete search history.

(56) References Cited

U.S. PATENT DOCUMENTS 4,973,257 A * 11/1990 Lhotak ..... 439/81
5,052,943 A * 10/1991 Davis ..... 439/357
5,057,027 A * 10/1991 Yamada et al. ..... 439/83
5,067,904 A * 11/1991 Takeuchi et al. ..... 439/73
5,478,261 A * 12/1995 Bogese, II ..... 439/676
5,667,393 A * 9/1997 Grabbe et al. ..... 600/443
5,842,875 A * 12/1998 Yagi ..... 439/74
5,951,335 A * 9/1999 Kurotori et al. ..... 439/733.1
6,217,391 B1 * 4/2001 Colantuono et al. ..... 439/676
6,227,893 B1 * 5/2001 Kaneko ..... 439/326
6,280,254 B1 * 8/2001 Wu et al. ..... 439/630
6,315,621 B1 * 11/2001 Natori et al. ..... 439/862
6,447,304 B1 * 9/2002 Korsunsky et al. ..... 439/66
6,561,819 B1 * 5/2003 Huang et al. ..... 439/66
6,659,799 B2 * 12/2003 Yang ..... 439/607
6,875,033 B2 * 4/2005 Sato et al. ..... 439/159
7,073,254 B2 * 7/2006 Eldridge et al. ..... 29/843
7,258,570 B2 * 8/2007 Asai ..... 439/495
7,287,986 B2 * 10/2007 Ho ..... 439/65

* cited by examiner

*Primary Examiner*—Alexander Gilman
(74) *Attorney, Agent, or Firm*—Jackson Walker, LLP

(57) ABSTRACT

A terminal has a soldering portion, a body portion, a resilient arm portion, a first fulcrum and a pivot boss. The body portion is formed on the soldering portion. The resilient arm portion is formed on the body portion, is capable of pivoting and has a proximal end, a distal contacting portion and a distal section. The first fulcrum is defined between the body portion and the resilient arm portion and allows the resilient arm portion to pivot around the first fulcrum. The pivot boss serves as a second fulcrum, is formed on the resilient arm portion between the proximal end and the distal contacting portion, is adjacent to the distal section and selectively pivots the distal section. With the pivot boss, the terminal presents excellent resilient force.

4 Claims, 5 Drawing Sheets

TERMINAL AND ELECTRICAL CONNECTOR

BACKGROUND OF THE INVENTION

1. Field of the Invention

The present invention relates to a terminal, and more particularly to a terminal that is mounted in an electrical connector and has an excellent resilience to provide sufficient resilient force to make the terminal tightly contact a terminal of a mating electrical connector or a memory card.

2. Description of Related Art

Electronic technology is developing rapidly, and portable electronic devices such as cellular phones and MPEG-1 Audio Layer 3 (MP3) players have become more compact and lighter. Therefore, electronic components inside the portable electronic devices are smaller. However, physical characteristics of the electronic components such as resilience and strength may be weaker when they are smaller. For example, terminals in a socket connector mounted in a portable electronic device would have their resilience characteristic decreasing substantially when the terminal is smaller. Therefore, the terminals loosely contact terminals of a plug connector, which will likely make signal transmission between the connectors unstable.

To overcome the shortcomings, the present invention provides a terminal and an electrical connector to mitigate or obviate the aforementioned problems.

SUMMARY OF THE INVENTION

The main objective of the invention is to provide a terminal that is mounted in an electrical connector and has excellent resilience to provide sufficient resilient force to make the terminal tightly contact a terminal of a mating electrical connector or a memory card.

A terminal in accordance with the present invention comprises a soldering portion, a body portion, a resilient arm portion, a first fulcrum and a pivot boss. The body portion is formed on the soldering portion. The resilient arm portion is formed on the body portion, is capable of pivoting and has a proximal end, a distal contacting portion and a distal section. The first fulcrum is defined at a boundary between the body portion and the resilient arm portion and allows the resilient arm portion to pivot around the first fulcrum. The pivot boss, serving as a second fulcrum, is formed on the resilient arm portion between the proximal end and the distal contacting portion, is located adjacent to the distal section and selectively pivots the distal section. With the pivot boss, the terminal presents excellent resilient force.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
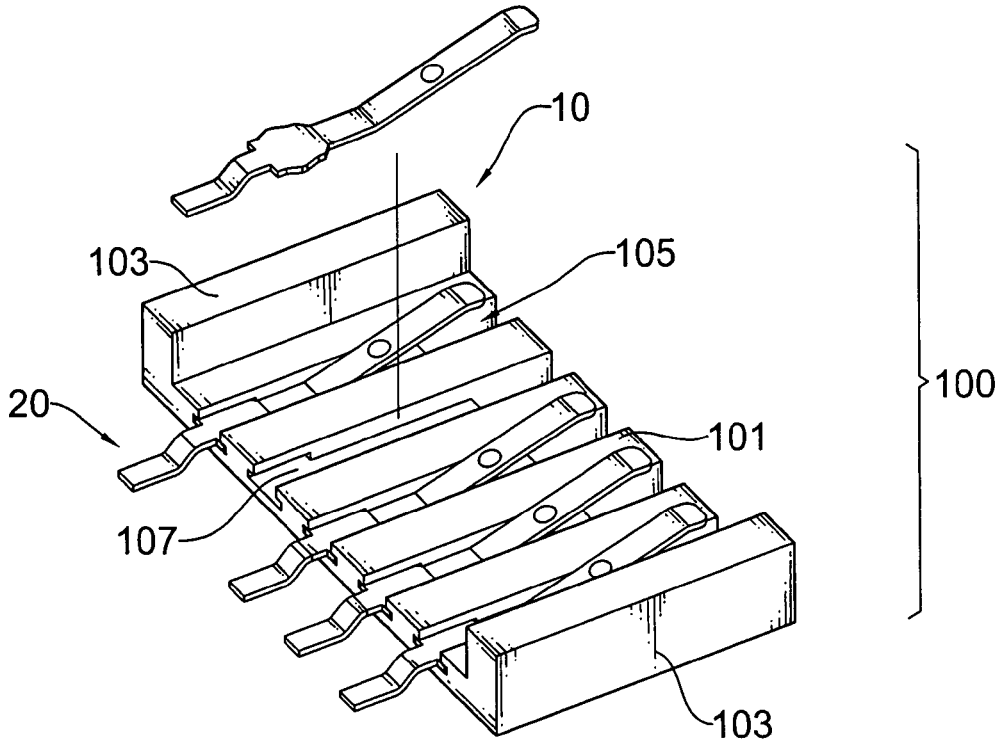
FIG. 1 is a perspective view of an electrical connector in accordance with the present invention.
Figure 2A:
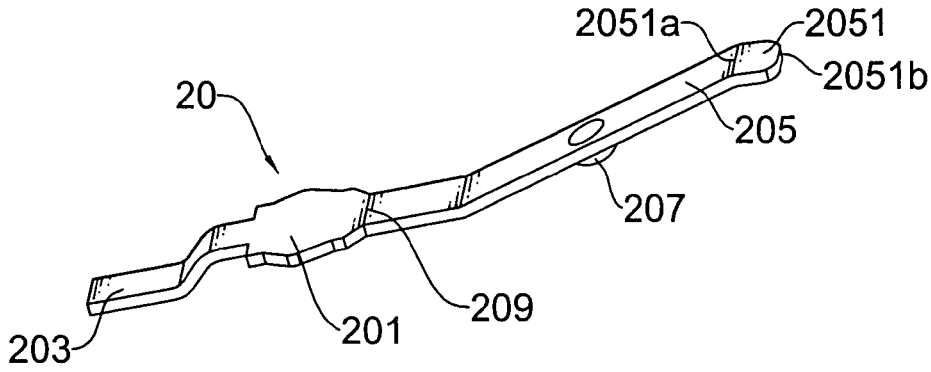
FIG. 2*a* is an enlarged perspective view of a terminal in the electrical connector in FIG. 1.

With reference to FIGS. 1 and 2*a*, according to the present invention, a terminal (20) is used in an electrical connector (100) that is mounted on and electrically connected with a printed circuit board (PCB) in an electronic device such as a cellular phone or a MPEG-1 Audio Layer 3 (MP3) player and may receive and hold a plug connector or a memory card.

The electrical connector (100) comprises an insulative housing (10) and a plurality of terminals (20).

The insulative housing (10) has a bottom (101), two sidewalls (103), a space and a plurality of mounting grooves (105).

The sidewalls (103) are formed on and protrude up from the bottom (101) opposite to each other.

The space is defined in the insulative housing (10) between the sidewalls (103) and may accommodate a plug connector or a memory card having a plurality of terminals.

The mounting grooves (105) are defined in the bottom (101) in the space, and each mounting groove (105) has an inner bottom surface (107).

Figure 2B:
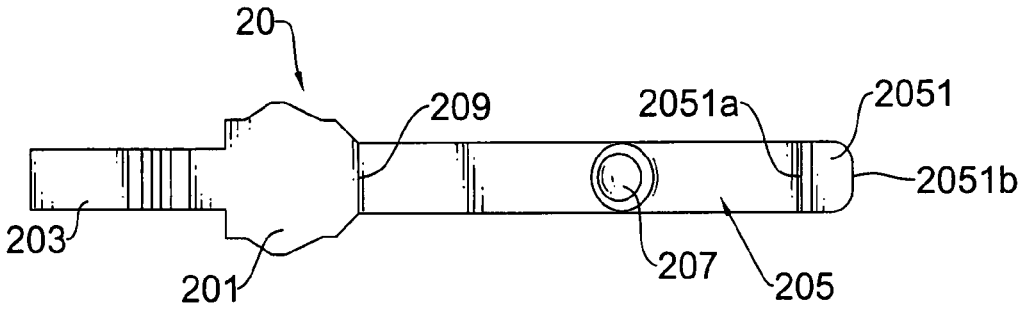
FIG. 2*b* is a top view of the terminal in FIG. 2*a;*
Figure 2C:
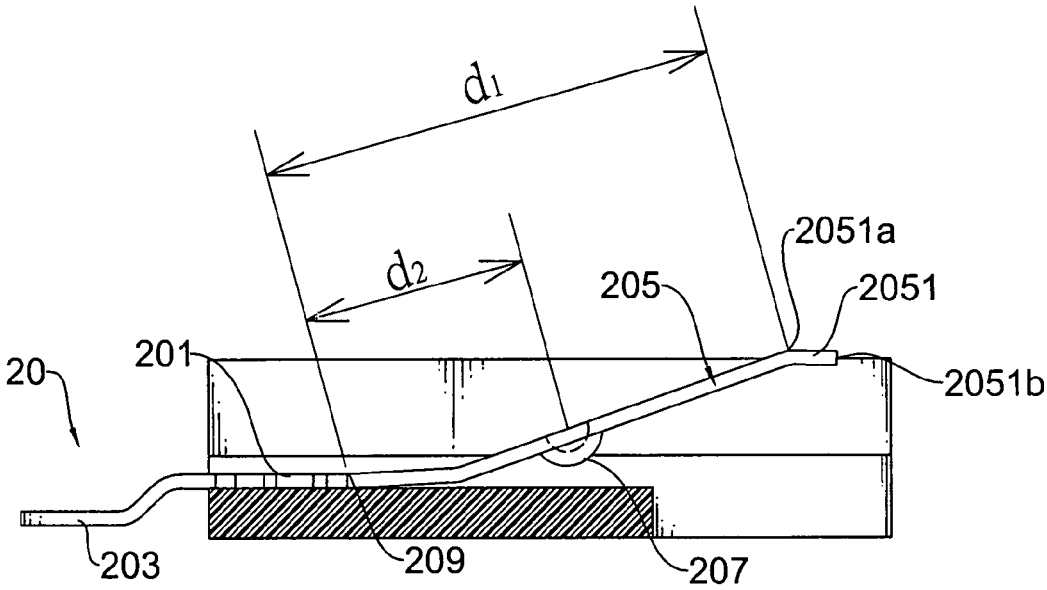
FIG. 2*c* is a side view in partial section of the electrical connector with the terminal in FIG. 2*b;*

With further reference to FIGS. 2*b* and 2*c*, the terminals (20) correspond respectively to and are mounted respectively in the mounting grooves (105). Each terminal (20) has a soldering portion (203), a body portion (201), a resilient arm portion (205), a first fulcrum (209) and a pivot boss (207).

The soldering portion (203) is mounted on and connected with the PCB.

The body portion (201) is formed on the soldering portion (203), is mounted in a corresponding mounting groove (105) and is parallel to the inner bottom surface (107) in the corresponding mounting groove (105).

The resilient arm portion (205) is flexible, is opposite to the soldering portion (203), is formed on and protrudes longitudinally from the body portion (201), is inclined relative to the body portion (201) and the inner bottom surface (107) in the corresponding mounting groove (105), is capable of pivoting toward the inner bottom surface and may contact one terminal of the plug connector or the memory card. The resilient arm portion (205) has a proximal end, a distal contacting portion (2051) and a distal section. The proximal end is connected with the body portion (201). The distal contacting portion (2051) is opposite to the proximal end and has a connected end (2051*a*) and a free end (2051*b*). The connected end (2051*a*) is connected with the resilient arm portion (205). The free end (2051*b*) is opposite to the connected end (2051*a*).

The distal section is formed adjacent to the free end (2051*b*) of the distal contacting portion (2051) at an interval from the proximal end.

Figure 2D:
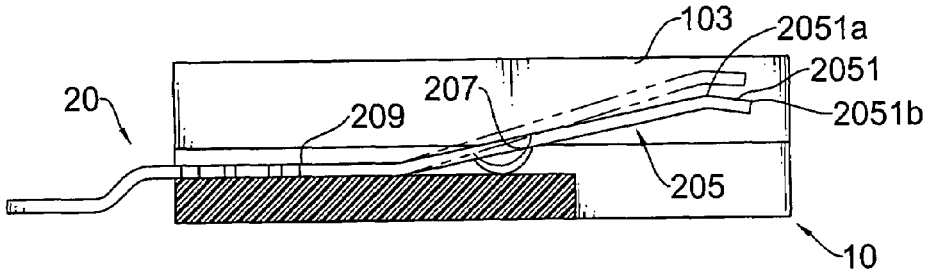
FIG. 2*d* is an operational side view in partial section of the terminal in FIG. 2*c* with a resilient arm portion pivoting around a first fulcrum.

With reference further to FIG. 2*d*, the first fulcrum (209) is defined between the body portion (201) and the resilient arm portion (205), is spaced apart from the connected end (2051*a*) of the distal contacting portion (2051) with a distance ($d_1$) and allows the resilient arm portion (205) to pivot down around the first fulcrum (209). The resilient arm portion (205) pivoting down provides a resilient force to make the resilient arm portion (205) tightly contact a terminal of the plug connector or the memory card.

Figure 2E:
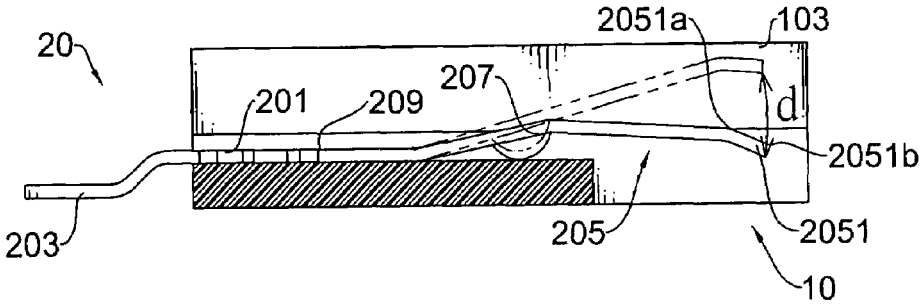
FIG. 2*e* is an operational side view in partial section of the terminal in FIG. 2*e* with a distal portion of the resilient arm portion further pivoting around a second fulcrum.
Figure 3A:
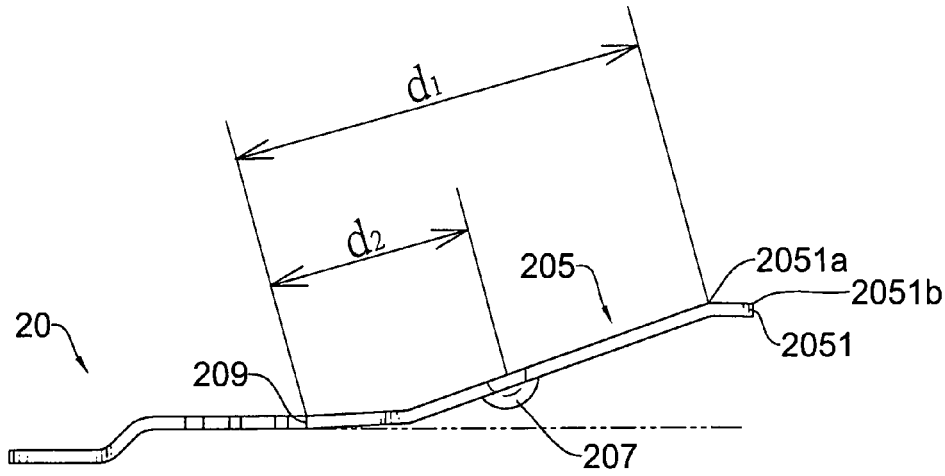
FIG. 3*a* is a side view of a first variant of the terminal in FIG. 2*c* with a ratio of a distance measured from the first fulcrum to the second fulcrum to a distance measured from the first fulcrum to the connected end of the distal contacting portion being 0.5.
Figure 3B:
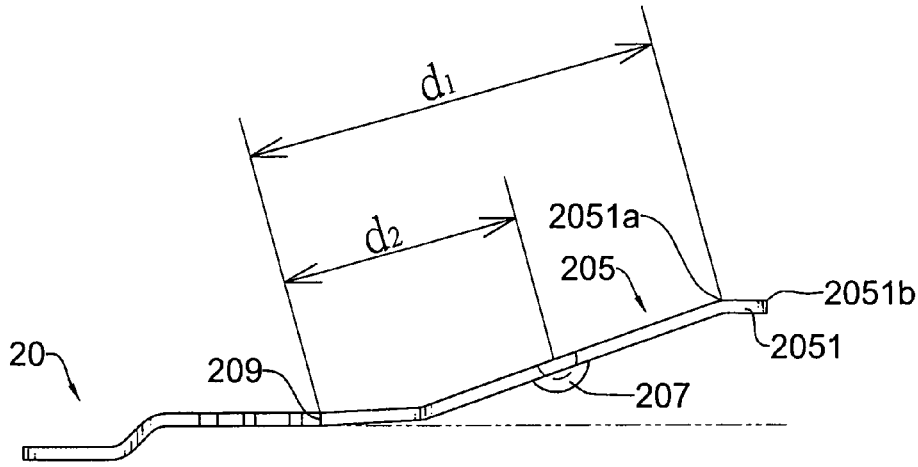
FIG. 3*b* is a side view of a second variant of the terminal in FIG. 2*c* with a ratio of the distance measured from the first fulcrum to the second fulcrum to the distance measured from the first fulcrum to the connected end of the distal contacting portion being 0.6.
Figure 3C:
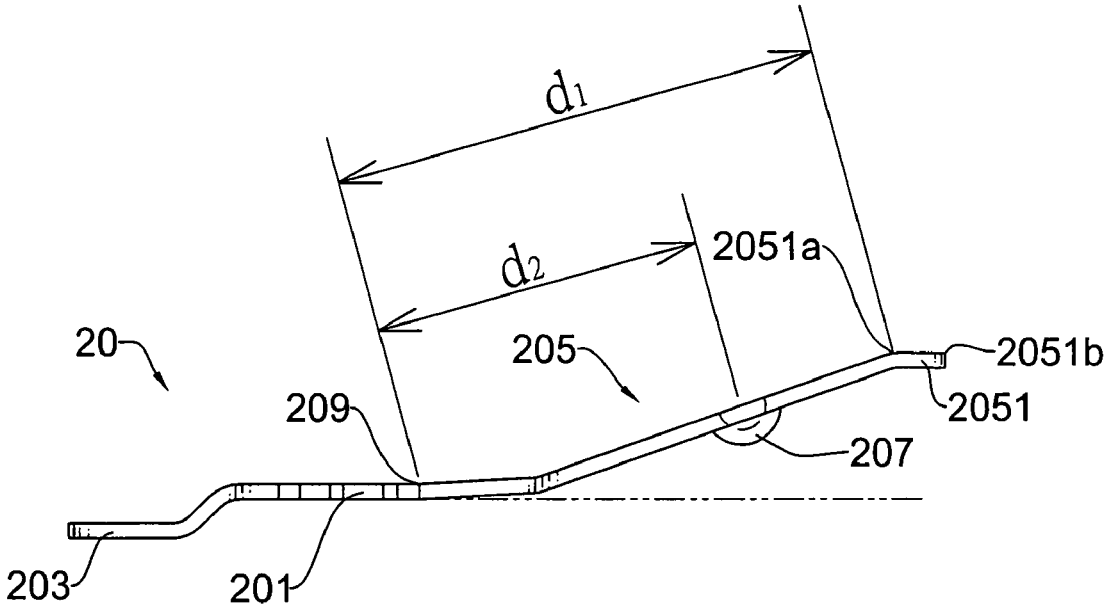
FIG. 3*c* is a side view of a third variant of the terminal in FIG. 2*c* with a ratio of the distance measured from the first fulcrum to the second fulcrum to the distance measured from the first fulcrum to the connected end of the distal contacting portion being 0.7.

With further reference to FIG. 2*e*, the pivot boss (207) serving as a second fulcrum, is formed on and protrudes from the resilient arm portion (205) between the proximal end and the distal contacting portion (2051), is adjacent to the distal section of the resilient arm portion (205), selectively abuts the inner bottom surface (107) and therefore pivots the distal section down. The distal section pivoting down provides a further resilient force to make the distal section more tightly contact the terminal of the plug connector or the memory card. The pivot boss (207), serving as the second fulcrum, is spaced apart from the first fulcrum (209) with a distance ($d_2$). The ratio of the distance ($d_2$) measured from the first fulcrum (209) to the second fulcrum to the distance ($d_1$) measured from the first fulcrum (209) to the connected end (2051*a*) of the distal contacting portion (2051) is in a range of 0.5-0.7. With further reference to FIG. 3*a*, a first variant of the terminal (20) has a ratio of 0.5. With further reference to FIG. 3*b*, a second variant of the terminal (20) has a ratio of 0.6. With further reference to FIG. 3*c*, a third variant of the terminal (20) has a ratio of 0.7.

With further reference to Table 1, the first, second and third variants of the terminal (20) and a conventional terminal are compared to one another. The conventional terminal has a soldering portion, a body portion, a resilient arm portion and a first fulcrum but does not have the pivot boss (205) when compared to the terminal (20) of the present invention. The table shows the foregoing ratios, the total resilient force of each depressed terminal and an irrecoverable deformation of each terminal after the terminal is released. The table is based on the depressed distal contacting portion (2051) of the resilient arm portion (205) experiencing a displacement (d) of 5 mm.

TABLE 1

| | First Variant of the Terminal of the Present Invention | Second Variant of the Terminal of the Present Invention | Third Variant of the Terminal of the Present Invention | Conventional Terminal |
|---|---|---|---|---|
| Ratio | 0.5 | 0.6 | 0.7 | |
| Resilient Force (g) | 40.20 | 77.00 | 28.67 | 27.95 |
| Irrecoverable Deformation (mm) | 0.0265 | 0.05421 | 0.02659 | 0.02189 |

With the ratio in the range of 0.5-0.7, the terminal (20) of the present invention limits its irrecoverable deformation to less than 0.055 mm that is acceptable and presents an excellent resilient force that is greater than that of the conventional terminal. Thus, the terminal (20) with the pivot boss (207) would contact the terminal of the plug connector or the memory card more tightly than the conventional terminal and provides stable signal transmission.

What is claimed is:

1. A terminal for an electrical connector, the terminal comprising a soldering portion;

a body portion formed on the soldering portion;

a resilient arm portion being flexible, being opposite to the soldering portion, formed on and protruding longitudinally from the body portion, inclined relative to the body portion, being capable of pivoting and having a proximal end connected with the body portion;

a distal contacting portion being opposite to the proximal end and having a connected end connected with the resilient arm portion; and a free end being opposite to the connected end; and a distal section formed adjacent to the free end of the distal contacting portion at an interval from the proximal end;

a first fulcrum defined between the body portion and the resilient arm portion and allowing the resilient arm portion to pivot around the first fulcrum; and a pivot boss serving as a second fulcrum, formed on and protruding from the resilient arm portion between the proximal end and the distal contacting portion, being adjacent to the distal section and selectively pivoting the distal section.

2. The terminal as claimed in claim 1, wherein the pivot boss is spaced apart from the first fulcrum with a distance;

the first fulcrum is spaced apart from the connected end of the distal contacting portion with a distance of the resilient arm portion; and a ratio of the distance measured from the first fulcrum to the second fulcrum to the distance measured from the first fulcrum to the connected end of the distal contacting portion is in a range of 0.5-07.

3. An electrical connector comprising an insulative housing having a bottom;

two sidewalls formed on and protruding up from the bottom opposite to each other;

a space defined in the insulative housing between the sidewalls; and a plurality of mounting grooves defined in the bottom in the space, and each mounting groove having an inner bottom surface; and a plurality of terminals corresponding respectively to and mounted respectively in the mounting grooves, and each terminal having a soldering portion;

a body portion formed on the soldering portion, mounted in a corresponding mounting groove and being parallel to the inner bottom surface in the corresponding mounting groove;

a resilient arm portion being flexible, being opposite to the soldering portion, formed on and protruding longitudinally from the body portion, inclined relative to the body portion and the inner bottom surface, being capable of pivoting toward the inner bottom surface and having a proximal end connected with the body portion;

a distal contacting portion being opposite to the proximal end and having a connected end connected with the resilient arm portion; and a free end being opposite to the connected end; and a distal section formed adjacent to the free end of the distal contacting portion at an interval from the proximal end;

a first fulcrum defined between the body portion and the resilient arm portion and allowing the resilient arm portion to pivot around the first fulcrum; and a pivot boss serving as a second fulcrum, being formed on and protruding from the resilient arm portion between the proximal end and the distal contacting portion, being adjacent to the distal section and selectively abutting the inner bottom surface to pivot the distal section.

4. The electrical connector as claimed in claim 3, wherein the pivot boss is spaced apart from the first fulcrum with a distance;

the first fulcrum is spaced apart from the connected end of the distal contacting portion with a distance of the resilient arm portion; and a ratio of the distance measured from the first fulcrum to the second fulcrum to the distance measured from the first fulcrum to the connected end of the distal contacting portion is in a range of 0.5-07.

* * * * *